United States Patent [19]

Batchelor

[11] Patent Number: 4,468,830

[45] Date of Patent: Sep. 4, 1984

[54] SPONGE MOP

[75] Inventor: Douglas R. Batchelor, Chicago, Ill.

[73] Assignee: Libman Broom Company, Arcola, Ill.

[21] Appl. No.: 507,591

[22] Filed: Jun. 24, 1983

[51] Int. Cl.[3] ..... A47L 13/146

[52] U.S. Cl. ..... 15/119 A; 15/244 R

[58] Field of Search ..... 15/116 A, 119 A, 244 R, 15/244 A

[56] References Cited

U.S. PATENT DOCUMENTS 2,883,689 4/1959 Vosbikian et al. ..... 15/119 A 2,967,317 10/1961 Richards ..... 15/119 A 3,147,502 9/1964 Richards ..... 15/119 A X

*Primary Examiner*—Edward L. Roberts

*Attorney, Agent, or Firm*—Marshall, O'Toole, Gerstein, Murray & Bicknell

[57] ABSTRACT

A sponge mop with wing sections which rotate together to fold a sponge against itself and apply pressure to expel water from the sponge. Slidable movement of a pressure applying member against the wing sections causes them to rotate together. After pressure is released, the wing sections return to a horizontal position with the sponge ready for mopping.

9 Claims, 23 Drawing Figures

12
16
14
90
104
106
26
34
94
28
54
74
72
110
100
108
30
24
22
32
36
38
48
44
46
81
40
60
62

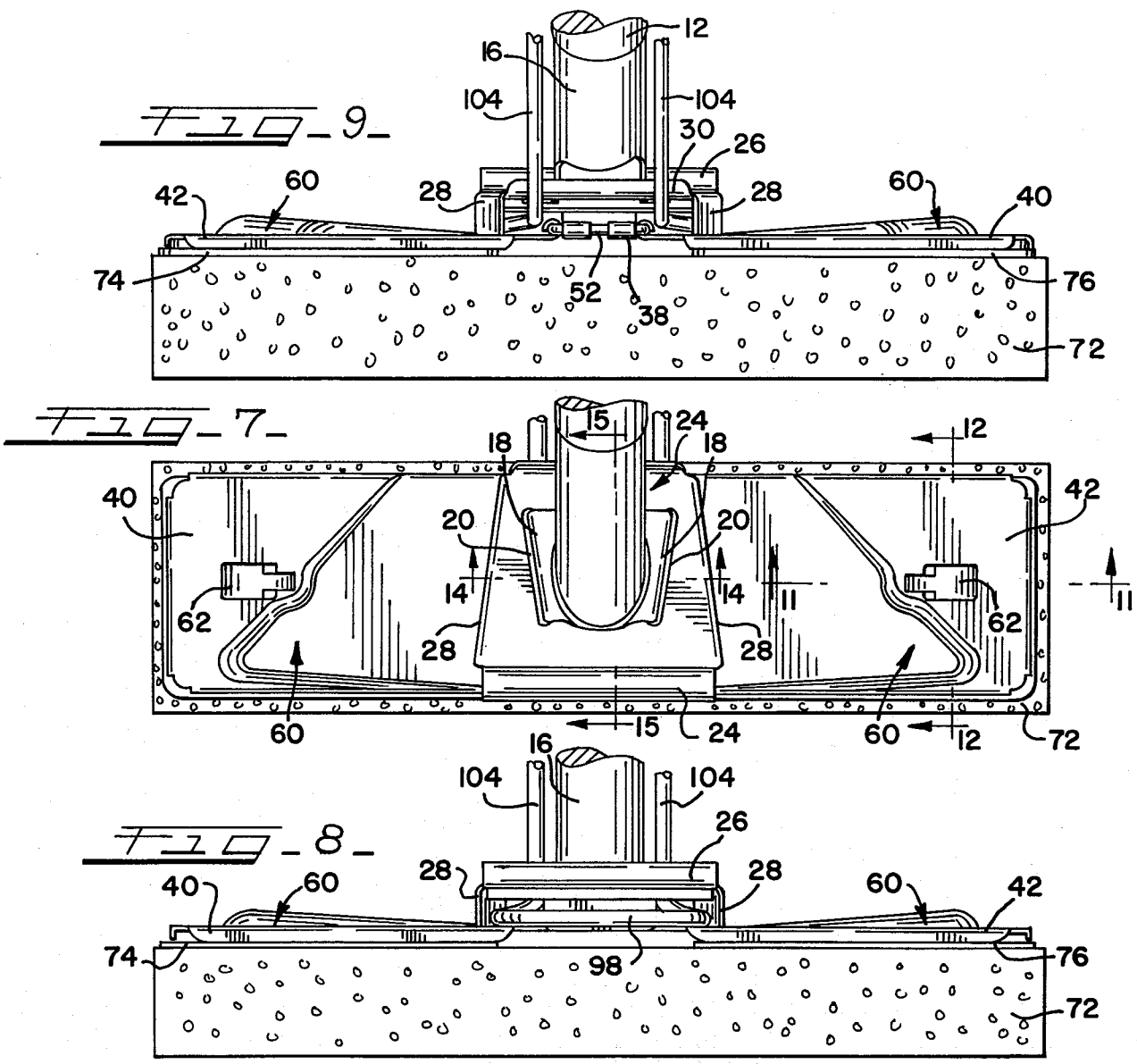
12
104
30
26
28
40
60
76
72
16
104
28
38
52
42
74
60
FIG. 9
42
11
12
62
60
72
11
28
20
14
24
18
24
15
15
18
20
14
28
40
62
60
FIG. 7
42
76
72
60
28
26
104
98
16
104
28
40
60
74
FIG. 8
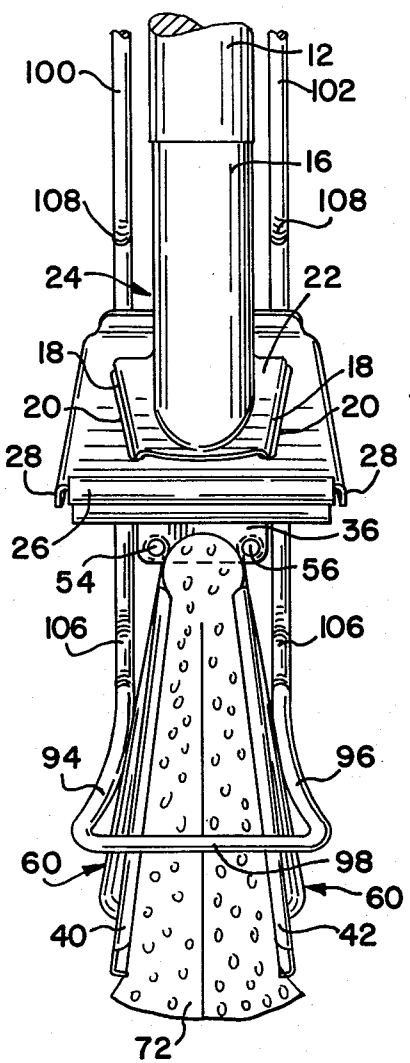
12
102
16
108
22
18
20
28
36
56
106
96
98
60
42
100
108
24
18
20
28
26
54
106
94
60
40
72
FIG. 6

SPONGE MOP

This invention relates to sponge mops. More particularly, this invention is concerned with an improved sponge mop characterized by ease of manufacture and a water extracting mechanism which is functionally simple, easy to operate and reliable.

BACKGROUND OF THE INVENTION

Sponge mops are widely used household utensils for washing floors, windows and walls. In general, a sponge mop comprises a handle with a bracket at one end which holds a resilient sponge, usually rectangular in shape. The sponge is generally removable when it is dirty or damaged so that a new sponge refill can be installed and the mop reused.

For most household uses it is desirable that the cleaning solution or rinse water be expelled or extracted from the sponge at various times during a cleaning operation. This is desirably done without wetting the hands, with little body bending and without lifting the sponge substantially above the height of a pail or bucket. Accordingly, various sponge mops have been developed, and some made available commercially, which include mechanisms for applying pressure to the sponge to squeeze out the water or cleaning solution. U.S. Pat. Nos. 2,643,407; 2,706,303; and 2,834,035 are representative of the prior art disclosing sponge mops with water extracting mechanisms. While the previously available sponge mops serve a useful purpose and have one or more desirable attributes, there is a need for a highly efficient simple sponge mop with a reliable water extracting mechanism which can be readily manufactured and made available commercially at an acceptable price in a competitive market.

SUMMARY OF THE INVENTION

According to the invention there is provided a sponge mop comprising a handle having a foot plate rigidly and fixedly attached to one end of the handle; a substantially planar rectangular supporting member, for a sponge, having a central panel with opposing side edges and a wing section pivotally joined to each said opposing side edge; hinge means pivotally connecting a front edge of the central panel to a front edge of the foot plate; means which pivotally urges the central panel toward the foot plate; means which pivotally urges each wing section into substantially planar alignment with the central panel but which permits the wing sections to pivotally move until they are about lateral to the central panel so as to position the wing sections opposite each other; and a mechanism for applying pressure to the wing sections to pivot them opposite each other so as to extract water from a sponge when mounted on the sponge supporting member by folding the sponge against itself.

The pressure applying mechanism comprises a member having a foot section with a pair of rigid rod portions, spaced apart slightly more than the distance between the means pivotally joining the wing sections to the central panel, positioned between the foot plate and the sponge supporting member and extending outwardly beyond the central panel, a forward end rod portion lateral to and joining together the ends of the foot section and an arm means joined to and extending from the pair of spaced apart rigid rod portions along the handle, and means to move the arm substantially axial to the handle to urge the foot section against the top surface of the wing sections to cause them to pivot together opposite each other as the foot section rods slide along the top surfaces of the wing sections.

The foot section of the pressure applying mechanism desirably urges the central panel toward the foot plate when the wing sections are in substantially planar alignment. However, when the foot section pushes the wing sections together to fold and press the sponge it can simultaneously cause the central panel to pivot downwardly away from the foot plate.

A hand grip can be slidably mounted on the handle and the arm means can include at least one rod joined to the hand grip. In this way, movement of the hand grip can displace the foot section to move the wing sections together to extract water from a sponge on the mop.

If desired, the hand grip is slidably mounted on the handle and the pair of rods from the foot section can extend therefrom along the handle and be joined to the hand grip.

The forward end rod portion can be made longer than the distance between the pair of rigid rod portions in the foot section when measured inwards from the end portion to help stiffen the foot section against bending.

The pair of rigid rod portions can have inwardly curved areas adapted to slidably press against the wing sections to rotate them with reduced friction.

The wing portions desirably have means to attach a sponge on the lower surface thereof.

The means which pivotally urges each wing section into substantially planar alignment with the central panel, but which permits the wing sections to pivotally move until they are about lateral to the central panel so as to position the wing sections opposite each other, also can be a spring means.

BRIEF DESCRIPTION OF THE DRAWINGS

FIG. 6 is a front elevational view of the mop almost closed as shown in FIGS. 2 and 5;

FIG. 7 is a front isometric view of the sponge mop head shown in open position like that in FIG. 1;

FIG. 8 is a front elevational view of the sponge mop head in open position as shown in FIG. 7;

FIG. 9 is a rear elevational view of the sponge mop head in open position;

DETAILED DESCRIPTION OF THE DRAWINGS

To the extent it is reasonable and practical, the same or similar elements or parts which appear in the various views of the drawings will be identified by the same numbers.

With reference to the drawings, the sponge mop 10 has a handle 12, which can be made of wood, a metal tube or plastic, long enough for a user to stand upright when mopping a floor. The lower end of handle 12 is connected to a ferrule 14 (FIG. 1) which has a tubular portion 16 for receiving the end of handle 12.

Figure 1:
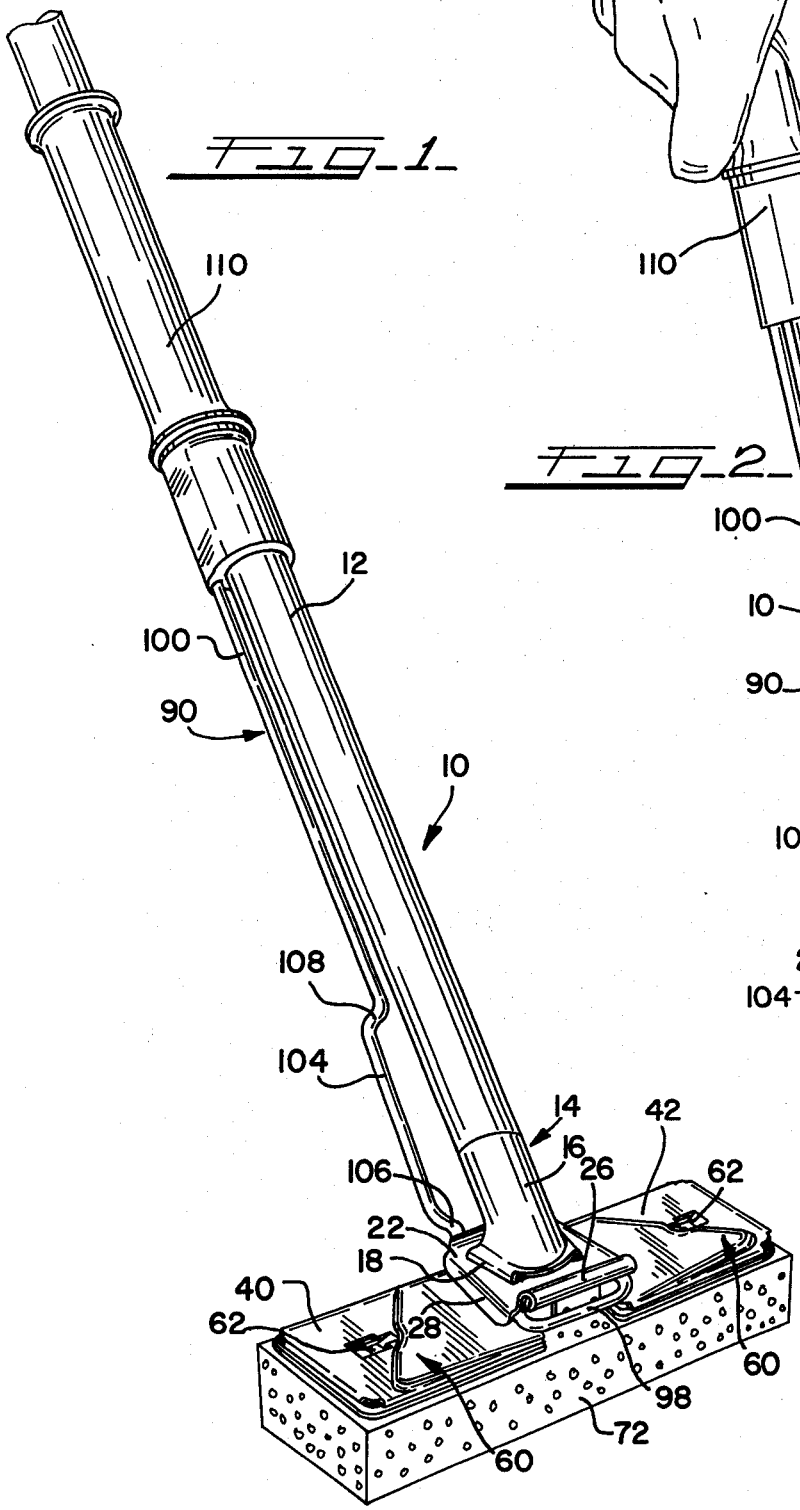
FIG. 1 is an isometric view of a sponge mop, according to the invention, with the upper part of the handle broken away and with the sponge mop positioned for cleaning
Figure 18:
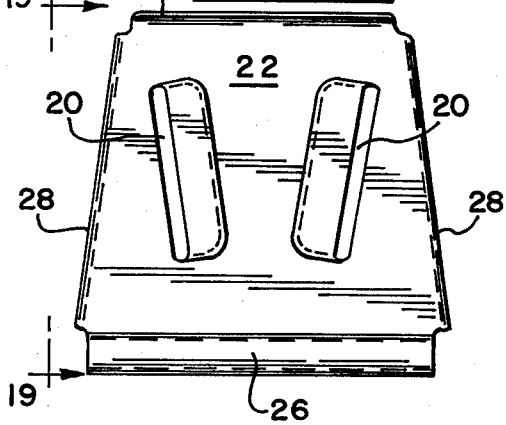
FIG. 18 is a plan view of the bracket portion of the foot plate assembly.

The lower end of ferrule 14 is slanted so as to position handle 12 at an acute angle when held by a user during mopping. A pair of spaced apart initially downwardly depending retaining flanges 18 fit into the pair of slots 20. in bracket 22 (FIGS. 1, 6 and 18). The flanges 18 are then bent inwardly toward each other into tight flat contact with the lower surface of bracket 22 to securely connect the ferrule thereto. Obviously, if desirable ferrule 14 can be welded to bracket 22. The combination of bracket 22 and ferrule 14 forms a foot plate 24.

Figure 19:
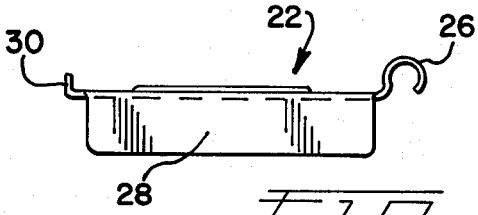
FIG. 19 is a side elevational view of the bracket taken along the line 19—19 of FIG. 18.
Figure 20:
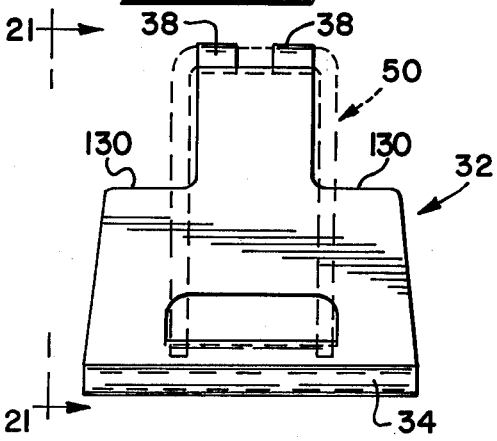
FIG. 20 is a plan view of the central panel to which each wing section is pivotally connected by the U-shaped pivot member shown in phantom.
Figure 21:
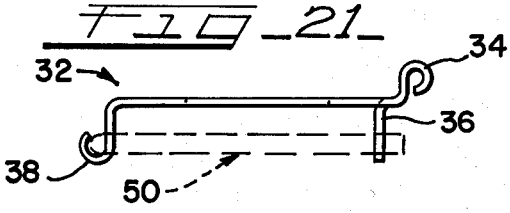
FIG. 21 is a side elevational view of the central panel taken along the line 21—21 of FIG. 20 with the Ushaped pivot member shown in phantom.
Figure 22:
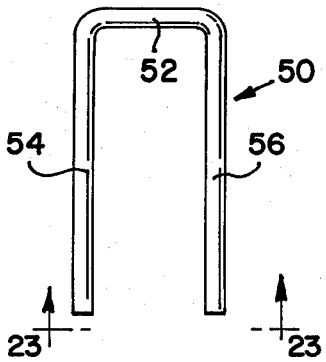
FIG. 22 is a plan view of the U-shaped pivot member shown in phantom in FIGS. 20 and 21.
Figure 23:
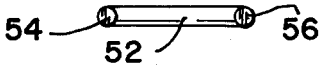
FIG. 23 is an end view of the U-shaped pivot member shown in FIG. 22.

Bracket 22 (FIGS. 18 and 19) has a front upwardly directed and downwardly curved longitudinal edge 26, generally C-shaped in section, and a pair of downwardly directed side flanges 28. Flanges 28 strengthen bracket 22 and limit upward movement of wings 40, 42 to maintain them horizontal when the mop is used. An upwardly directed flange 30 is provided on the rear or back edge of bracket 22 to strengthen it and to provide a rounded corner against which the curved bend 106 in rods 104 can rub.

A central plate 32 or bridge (FIGS. 5, 15, 20 and 21) is operably connected to bracket 22. Central plate 32 has a front upwardly directed and downwardly curved longitudinal edge 34. Curved edge 34 is sized to slide into the C-shaped edge 26 of bracket 22 in a hingeable manner. Downwardly directed flange 36 is provided in the forward part of plate 32, such as by shearing out a three sided area in the plate and bending it downwardly along the uncut edge. Two spaced apart holes are provided in flange 36 to receive the ends of U-shaped pivot member 50. Two legs of the rear edge of central plate 32 are bent downwardly and then curved upwardly into a C-shaped form 38 adapted to receive the closed end portion 52 of U-shaped pivot member 50.

A pair of wing sections 40 and 42 form part of the sponge mop apparatus. The wing sections 40 and 42 are similar to, but mirror images of each other. The inner edge of each wing section 40 and 42 has a cut out area 44 in which a torsion spring 46 (FIG. 5) can fit. The inner edge of each wing adjacent cut out area 44 is curved upwardly into a looped form 48 to provide a hole into which a leg 54 or 56 of U-shaped pivot member 50 can extend. The legs 54 and 56 are integral with closed end portion 52 of the U-shaped pivot member 50.

Each wing section 40, 42 (FIG. 10) has a raised embossed portion 60 which provides a surface against which member 90, to be described subsequently, smoothly glides. Portion 90 also strengthens and improves the appearance of each wing section. More importantly, each wing section 40, 42 has a flanged retaining tab 62 formed by pressing the metal of each wing with a die to downwardly shear and shape the metal to form the tab.

Figure 10:
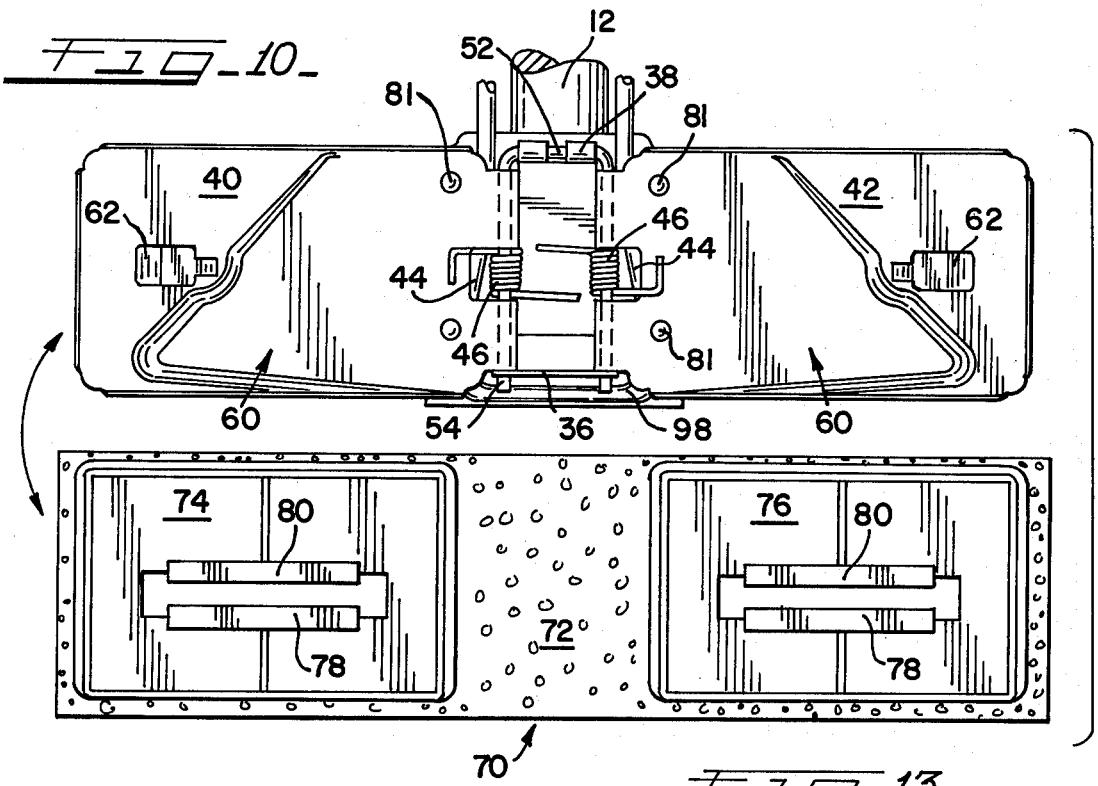
FIG. 10 is a composite view showing the lower surface of the mop head and the top surface of a sponge mop refill attachable to the mop head.
Figure 11:
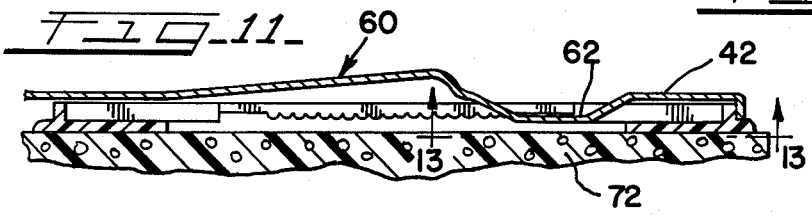
FIG. 11 is a sectional view taken along the line 11—11 of FIG. 7.
Figure 13:
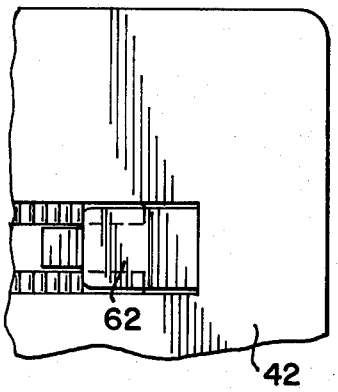
FIG. 13 is a sectional view taken along the line 13—13 of FIG. 11.
Figure 12:
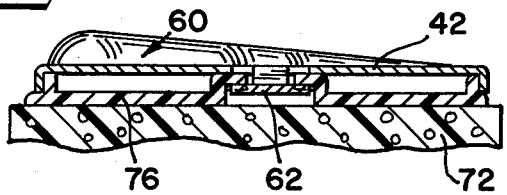
FIG. 12 is a sectional view taken along the line 12—12 of FIG. 7.
Figure 14:
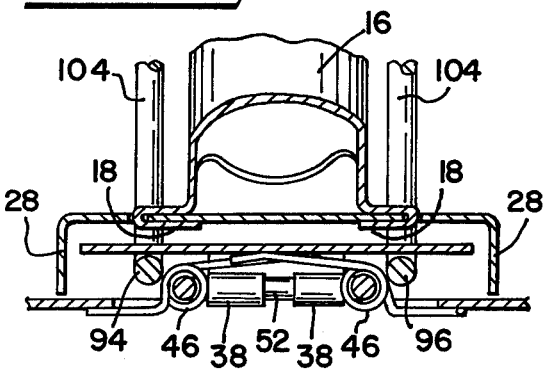
FIG. 14 is a sectional view taken along the line 14—14 of FIG. 7.
Figure 15:
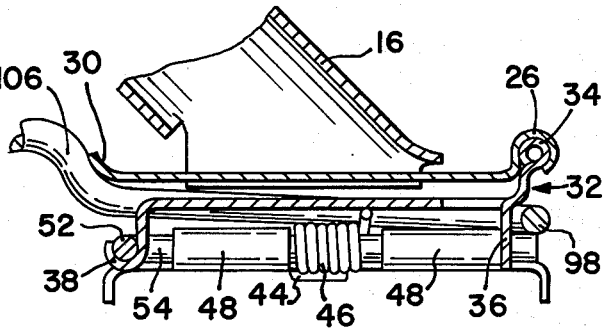
FIG. 15 is a sectional view taken along the line 15—15 of FIG. 7.

As shown in FIG. 10, sponge mop refill 70 includes a sponge 72, of generally rectangular shape, to which spaced apart plastic retaining plates 74 and 76 are adhesively bonded. Each plate 74 and 76 contains spaced apart horizontal flanges 78, 80 which engage with tabs 62 to removably secure the sponge mop refill 70 to the mop head. The refill is put in place on the mop head by sliding it on each tab in a direction from the central plate 32 towards the outer end of each respective wing section 40, 42. Downwardly directed dimples 81 (FIG. 10) in the wing sections restrain unintentional release of the mop refill 70 from the mop head by engaging with the inner edge of plates 74, 76.

Figure 16:
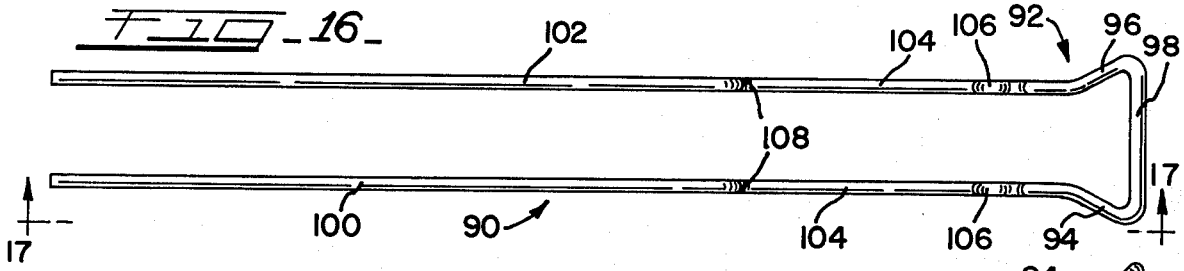
FIG. 16 is a plan view of the pressure applying member for squeezing the sponge.
Figure 17:
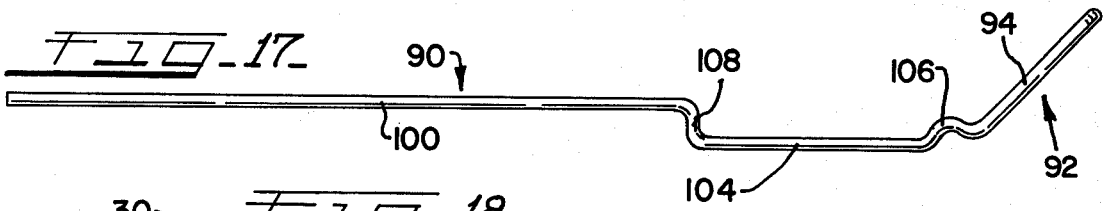
FIG. 17 is a side elevational view of the pressure applying member taken along the line 17—17 of FIG. 16.

The sponge mop apparatus includes a mechanism for applying pressure to the wing sections 40, 42 to pivot them opposite each other so as to extract, squeeze or expel water from the sponge 72. The mechanism, in the embodiment illustrated by the drawings, includes a member 90 connected to hand grip 110 slidably mounted on handle 12. The member 90 (FIGS. 16 and 17) has a foot section 92 with a pair of identical rigid rod portions 94, 96 spaced apart slightly more than the distance between the looped forms 48 of the wing sections. Forward end rod portion 98 integrally joins together the ends of rod portions 94, 96. Arm means comprising identical extensions 100 and 102 of rod portions 94, 96 respectively run more or less along handle 12 and terminate in holes provided in hand grip 110 to which they are securely connected. Each rod contains a detent portion 104 so that it slidably clears the curved corner of flange 30 during squeezing of the sponge. Also, each rod contains an upwardly curved portion 106 which is located to lock against the back of flange 30 when the mop is positioned as shown in FIG. 1 in use to mop a floor. The foot section 92 is generally contoured so as to lie beneath bracket 22 with the rod portions 94, 96 close to flanges 28 when the mop is used on a floor. Furthermore, the rod end portion 98, at that time, is located beneath C-curved portion 26 of bracket 22.

To assemble the mop from the described pieces, the two wing sections are connected to the central plate 32 by use of U-shaped pivot member 50, with springs 46 put in place on legs 54, 56 as required. Springs 46 are installed with sufficient applied torsion to cause the wing sections to rotate upwardly relative to the central plate 32. After those pieces are assembled as described, the C-shaped portion 38 is bent tightly around end 52 to hold it in place. In this way, a substantially planar rectangular supporting member for the sponge refill is formed.

With the foot plate 24 in place on handle 12, the looped portion 34 of central plate 32 is slid into C-shaped portion 26 thereby pivotally joining those elements together. The wing sections 40, 42 are then pressed together, without a sponge supported thereon, as broadly shown in FIG. 6. The two wing sections, while pressed together, are then directed between rod portions 94, 96. Then the extensions 100, 102 are brought up close to handle 12 and held there while the wing sections 40, 42 are released. The torsional force of the two springs 46 pivot the wing sections upwardly until they reach a straight-out position and hit the lower edge of flanges 28 which stop them from further upward pivotal movement. The outward movement of wing sections 40, 42 caused by the torsional force of the springs 46 causes the wings to press against rod portions 94, 96. This moves them against the edges 130 (FIG. 20) of central plate 32 so that they apply pressure to that plate and cause it to rotate into parallel position beneath bracket 22. With the rods positioned in that manner, and with the foot section 92 between the bracket 22 and central plate 32, the ends of arm means rod extensions 100, 102 can be inserted into the holes in hand grip 110. The mop refill can then be installed on the mop head as already described. The mop is then ready for use by dipping it in water or a detergent solution.

Figure 2:
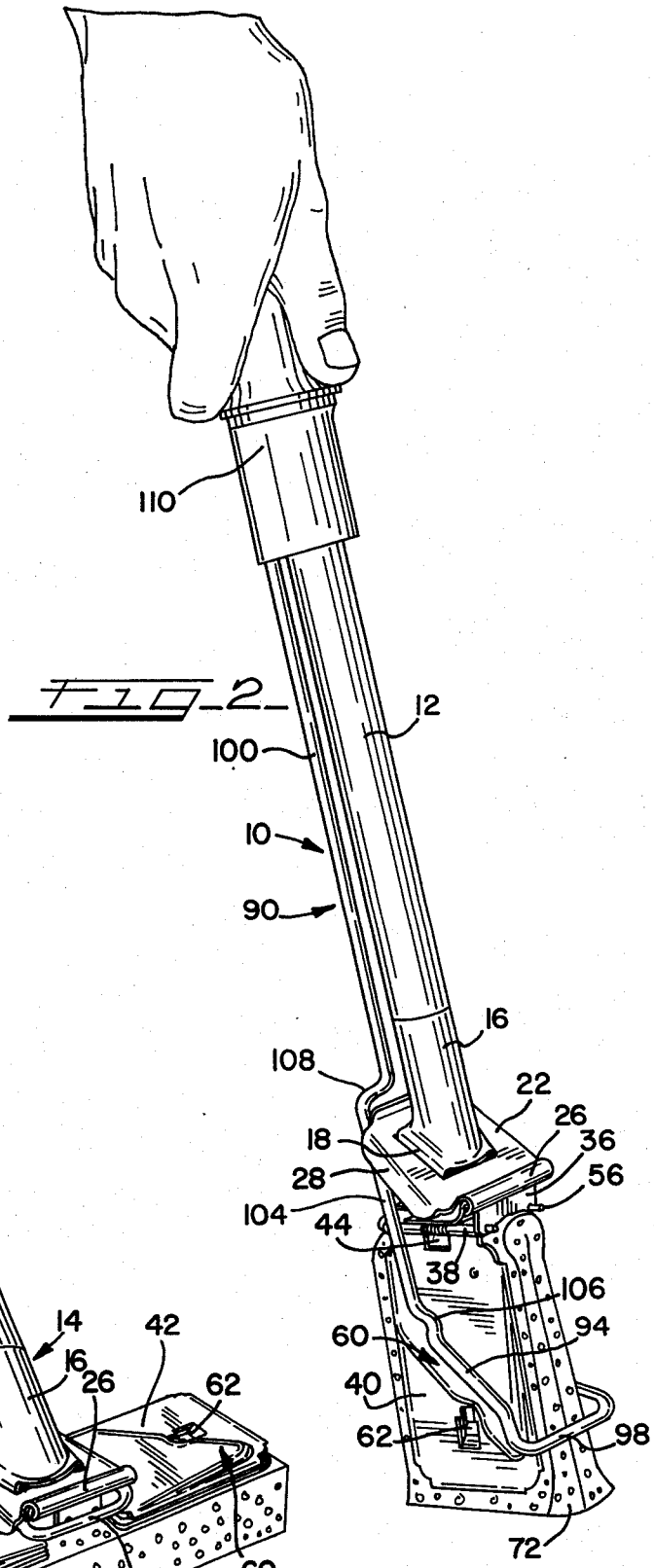
FIG. 2 is an isometric view of the sponge mop, shown in FIG. 1, nearly fully closed to squeeze out or expell water from the sponge.
Figures 3, 4, 5:
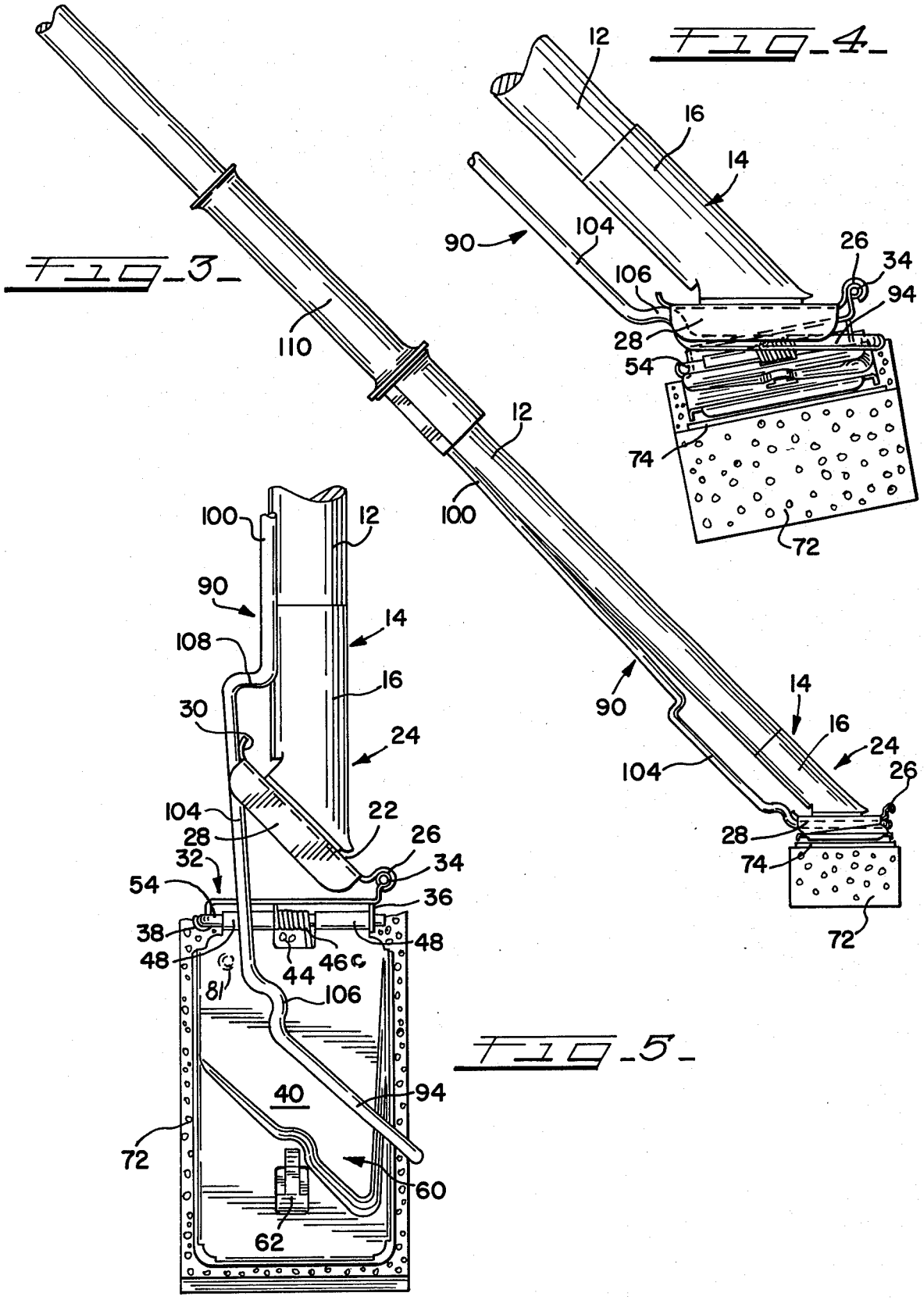
FIG. 3 is a side elevational view of the sponge mop shown in FIG. 1.
FIG. 4 is a side elevational view of the sponge mop with the pressure applying mechanism partially advanced to squeeze the sponge.
FIG. 5 is a side elevational view of the sponge mop nearly closed as shown in FIG. 2.

To extract or expell water or detergent solution from the sponge the user pushes or slides the hand grip 110 downwardly. This causes the rod portions 94, 96 to move forward and press against the raised areas 60 of the wing sections. Simultaneously, the looped portion 34 of central plate 32 pivots or rotates in C-shaped edge portion 26 of bracket 22. Plate 32 accordingly starts to rotate away from bracket 22. FIG. 4 illustrates an early stage of this movement. This combined rotation of plate 32 relative to bracket 22, plus rotation of the wing sections toward each other, results in pressure being applied to folded sponge 72, causing water to be expelled from the sponge. Such pressure applying action can be stopped after full application of pressure or at any intermediate pressure level. Full pressure is generally reached when step-bends 108 (FIG. 16) in member 90 contact flange 30 of bracket 22. At this full pressure stage, the folded sponge will be squeezed approximately to the extent shown in FIG. 2, thereby expelling a maximum amount of water. Once the desired amount of water is expelled from the sponge the hand grip 110 is pulled up on the handle until the mop head is horizontally located as shown in FIG. 1. The mop can then be used to dry a floor, or be placed in water to absorb a cleaning liquid or rinse water, depending on the user's intent.

The foregoing detailed description has been given for clearness of understanding only, and no unnecessary limitations should be understood therefrom, as modifications will be obvious to those skilled in the art.

What is claimed is:

1. A sponge mop comprising:

a handle having a foot plate rigidly and fixedly attached to one end of the handle;

a substantially planar rectangular supporting member, for a sponge, having a central panel with opposing side edges and a wing section pivotally joined to each said opposing side edge;

hinge means pivotally connecting a front edge of the central panel to a front edge of the foot plate;

means which pivotally urges each wing section into substantially planar alignment with the central panel but which permits the wing sections to pivotally move until they are about lateral to the central panel so as to position the wing sections opposite each other;

a mechanism for applying pressure to the wing sections to pviot them opposite each other so as to extract water from a sponge when mounted on the sponge body supporting member by folding the sponge against itself, comprising a member having a foot section with a pair of rigid rod portions, spaced apart slightly more than the distance between the means pivotally joining the wing sections to the central panel, positioned between the foot plate and the sponge supporting member and extending outwardly beyond the central panel, a forward end rod portion lateral to and joining together the ends of the rigid rod portions and an arm means joined to and extending from the pair of spaced apart rigid rod portions along the handle, and means to move the arm means substantially axial to the handle to urge the rigid rod portions of the foot section against the top surface of the wing sections to cause them to pivot together opposite each other as the rigid rod portions slide along the top surfaces of the wing section; and means which pivotally urges the central panel toward the foot plate.

2. A sponge mop according to claim 1 in which the means to move the arm means comprises a hand grip slidably mounted on the handle and the arm means includes at least one rod joined to the pair of rigid rod portions and to the hand grip.

3. A sponge mop according to claim 1 in which the means to move the arm means comprises a hand grip slidably mounted on the handle and the arm means includes a rod extending along the handle from each rigid rod portion to the hand grip.

4. A sponge mop according to claim 1 in which the foot section forward end rod portion is longer than the distance between the pair of rigid rod portions in the foot section when measured inwards from the end portion.

5. A sponge mop according to claim 4 in which the pair of rigid rod portions have inwardly curved areas adapted to slidably press against the wing sections.

6. A sponge mop according to claim 1 in which the wing portions have means to attach a sponge on the lower surface thereof.

7. A sponge mop according to claim 1 in which the means which pivotally urges each wing section into substantially planar alignment with the central panel, but which permits the wing sections to pivotally move until they are about lateral to the central panel so as to position the wing sections opposite each other, is a spring means.

8. A sponge mop according to claim 1 in which the foot section also comprises the means which pivotally urges the central panel toward the foot plate when the wing sections are in substantially planar alignment.

9. A sponge mop according to claim 1 in which the foot section also causes the central panel to pivot downwardly away from the foot plate as the foot section pushes the wing sections together.

* * * * *

UNITED STATES PATENT AND TRADEMARK OFFICE

CERTIFICATE OF CORRECTION

PATENT NO. : 4,468,830

DATED : September 4, 1984

INVENTOR(S) : DOUGLAS R. BATCHELOR

It is certified that error appears in the above-identified patent and that said Letters Patent is hereby corrected as shown below:

Column 2, line 41, after "cleaning" insert --a floor;--;

column 3, line 19, change "Ushaped" to --U-shaped--;

column 6, line 10, change "pviot" to --pivot--.

Signed and Sealed this

First Day of January 1985

[SEAL]

*Attest:*

*Attesting Officer*

GERALD J. MOSSINGHOFF

*Commissioner of Patents and Trademarks*